US010190779B2

(12) United States Patent
Palacios Valdueza et al.

(10) Patent No.: US 10,190,779 B2
(45) Date of Patent: Jan. 29, 2019

(54) GAS BURNER, GAS BURNER ARRANGEMENT AND COOKING ZONE

(71) Applicant: BSH Hausgeräte GmbH, Munich (DE)

(72) Inventors: Luis Antonio Palacios Valdueza, Astillero (ES); Emilio Placer Maruri, Liencres (ES); Roberto Saiz Gonzalez, Santander (ES)

(73) Assignee: BSH Hausgeräte GmbH, Munich (DE)

( * ) Notice: Subject to any disclaimer, the term of this patent is extended or adjusted under 35 U.S.C. 154(b) by 134 days.

(21) Appl. No.: 15/105,691

(22) PCT Filed: Dec. 16, 2014

(86) PCT No.: PCT/IB2014/066979

§ 371 (c)(1),
(2) Date: Jun. 17, 2016

(87) PCT Pub. No.: WO2015/092686

PCT Pub. Date: Jun. 25, 2015

(65) Prior Publication Data

US 2016/0320065 A1 Nov. 3, 2016

(30) Foreign Application Priority Data

Dec. 18, 2013 (ES) ..... 201331855

(51) Int. Cl.
*F24C 3/00* (2006.01)
*F24C 3/08* (2006.01)
*F24C 3/10* (2006.01)

(52) U.S. Cl.
CPC ..... *F24C 3/082* (2013.01); *F24C 3/085* (2013.01); *F24C 3/10* (2013.01); *F24C 3/103* (2013.01); *F23D 2207/00* (2013.01)

(58) Field of Classification Search
CPC ..... F23C 3/082; F23C 3/085
USPC ..... 126/39 E, 39 R, 39 N, 39 K, 39 H
See application file for complete search history.

(56) References Cited

U.S. PATENT DOCUMENTS

2008/0308089 A1 12/2008 Tecirlioglu
2009/0145422 A1* 6/2009 Paesani ..... F23D 14/06 126/39 E
2009/0173333 A1 7/2009 Kwon et al.
2012/0152230 A1* 6/2012 Armanni ..... F23D 14/065 126/39 E

FOREIGN PATENT DOCUMENTS

EP 2267371 A2 12/2010
EP 2369239 A2 9/2011
(Continued)

OTHER PUBLICATIONS

International Search Report PCT/IB2014/066979 dated Apr. 16, 2015.
National Search Report ES P 201331855 dated Dec. 18, 2013.

*Primary Examiner* — Vivek Shirsat
(74) *Attorney, Agent, or Firm* — Michael E. Tschupp; Andre Pallapies; Brandon G. Braun

(57) ABSTRACT

A gas burner for a cooktop includes a contact surface configured to come into surface contact with a cooktop plate of the cooktop. A holding device has a thermal element receiving slot which is adapted to allow a thermal element to be pushed into the thermal element receiving slot laterally parallel to the contact surface.

27 Claims, 6 Drawing Sheets

(56) References Cited

FOREIGN PATENT DOCUMENTS

| | | | |
|---|---|---|---|
| EP | 2439454 | A1 | 4/2012 |
| WO | 2004001295 | A1 | 12/2003 |
| WO | 2006077058 | | 7/2006 |

* cited by examiner

GAS BURNER, GAS BURNER ARRANGEMENT AND COOKING ZONE

CROSS-REFERENCES TO RELATED APPLICATIONS

This application is the U.S. National Stage of International Application No. PCT/IB2014/066979, filed Dec. 16, 2014, which designated the United States and has been published as International Publication No. WO 2015/092686 and which claims the priority of Spanish Patent Application, Serial No. P201331855, filed Dec. 18, 2013, pursuant to 35 U.S.C. 119(a)-(d).

BACKGROUND OF THE INVENTION

The present invention relates to a gas burner, a gas burner arrangement and a cooktop. The cooktop is in particular a gas cooktop.

To fasten a thermal element or ignition element of a gas burner to the gas burner or to a burner pan of the gas burner, the thermal element or ignition element can be clamped securely to the gas burner or burner pan with the aid of additional elements.

BRIEF SUMMARY OF THE INVENTION

In view of this, it is one object of the present invention to provide an improved gas burner.

A gas burner for a cooktop is therefore proposed, with a holding device for holding a thermal element, a contact surface which is designed to come into surface contact with a cooktop plate of the cooktop, the holding device having a thermal element receiving slot, into which the thermal element can be pushed laterally parallel to the contact surface.

The gas burner preferably has a base segment or burner pan. The burner pan preferably comprises a pan-type burner receiving segment. A nozzle receiving segment for receiving a gas injector nozzle of the gas burner can be provided in the center of a base of the burner receiving segment. A gas connector of the burner pan allows gas to be supplied to the gas injector nozzle by way of a gas line. The burner pan can also have the contact surface, which preferably runs all the way round the edge of the burner receiving segment in the manner of a ring. The contact surface can have two lateral fastening segments, on which fastening holes are provided to screw the burner pan to a fastening ring. Provision of the thermal element receiving slot allows the thermal element to be mounted quickly and simply on the gas burner or the burner pan without additional elements. Side flanks of the thermal element receiving slot are preferably positioned perpendicular to the contact surface. In particular the thermal element can be pushed into the thermal element receiving slot from the side.

According to one embodiment a housing of the thermal element can engage behind the thermal element receiving slot with a form fit so that the thermal element can be fixed perpendicular to the contact surface.

In particular the thermal element can be fixed in a z direction of the burner pan with the aid of the thermal element receiving slot. The housing of the thermal element can have a pin-type base body and two flanges running round the edge of the base body in the manner of a ring. The flanges are preferably arranged at a distance from one another. In particular the thermal element receiving slot engages between the flanges of the housing of the thermal element with the aid of an engagement segment. This ensures that the thermal element is fixed securely in the z direction.

According to a further embodiment the holding device is plate-shaped.

The holding device preferably extends laterally out of the contact segment. In particular the contact segment and the holding device are configured from a single piece of material. The holding device can in particular be configured in the manner of a hook.

According to a further embodiment the holding device is additionally designed to hold an ignition element of the gas burner.

This allows the ignition element to be fastened to the gas burner or the burner pan without additional parts. The ignition element can be a spark plug. The ignition element is in particular an electric ignition element. The ignition element is preferably a piezo element.

According to a further embodiment the holding device has an ignition element receiving slot, into which the ignition element can be pushed laterally parallel to the contact surface.

This allows quick and simple mounting of the ignition element on the burner pan without additional parts. The ignition element receiving slot preferably has side flanks which are positioned perpendicular to the contact surface.

According to a further embodiment a housing of the ignition element can engage behind the ignition element receiving slot with a form fit so that the ignition element can be fixed perpendicular to the contact surface.

In particular the ignition element can be fixed in the z direction of the burner pan. The housing of the ignition element preferably has a pin-type base body and two flanges running round the edge of the base body in the manner of a ring. The ignition element receiving slot can engage between the flanges with a form fit with the aid of an engagement segment.

According to a further embodiment the thermal element receiving slot and the ignition element receiving slot are arranged in such a manner that they run toward one another.

In particular a center line of the thermal element receiving slot intersects a center line of the ignition element receiving slot.

According to a further embodiment the thermal element receiving slot and the ignition element receiving slot are arranged at a predefined angle to one another.

In particular the center line of the thermal element receiving slot and the center line of the ignition element receiving slot intersect at the predefined angle. The predefined angle is preferably 90° to 120°, more preferably 95° to 115°, more preferably 100° to 110°.

According to a further embodiment the gas burner can be screwed to a fastening ring that can be positioned on the cooktop plate.

In particular the burner pan can be screwed to the fastening ring. The fastening ring preferably has mounting holes, with the aid of which the burner pan can be screwed to the fastening ring. The fastening ring preferably has a recess for both the thermal element and the ignition element, the thermal element and the ignition element being pushed through the corresponding recesses when the burner pan is mounted on the cooktop plate in order to fix the thermal element and the ignition element additionally in the x and y directions of the burner pan.

A gas burner arrangement with such a gas burner and a thermal element is also proposed, the thermal element being pushed into the thermal element receiving slot laterally parallel to the contact surface.

According to one embodiment a housing of the thermal element engages behind the thermal element receiving slot with a form fit so that the thermal element is fixed perpendicular to the contact surface.

In particular the thermal element is fixed in the z direction of the burner pan with the aid of the thermal element receiving slot.

According to a further embodiment the gas burner arrangement also has an ignition element, which is pushed into an ignition element receiving slot of the holding device laterally parallel to the contact surface.

According to a further embodiment a housing of the ignition element engages behind the ignition element receiving slot with a form fit so that the ignition element is fixed perpendicular to the contact surface.

In particular the ignition element is fixed in the z direction of the burner pan with the aid of the ignition element receiving slot.

A cooktop, in particular a gas cooktop, with such a gas burner and/or such a gas burner arrangement is also proposed.

The cooktop is in particular a gas cooktop. The cooktop can be part of a domestic appliance.

According to one embodiment the cooktop also has a cooktop plate and a fastening ring, which is designed to connect the gas burner to the cooktop plate.

The fastening ring preferably has a recess for both the housing of the thermal element and the housing of the ignition element. The thermal element and the ignition element are pushed through the corresponding recesses of the fastening ring when the gas burner or burner pan is mounted on the cooktop plate, thereby additionally being fixed in the x and y directions of the burner pan as well as in the z direction.

Further possible implementations of the invention also comprise combinations of features or embodiments described above or below in relation to the exemplary embodiments that are not cited specifically. The person skilled in the art will also add individual aspects to improve or supplement the respective basic form of the invention here.

BRIEF DESCRIPTION OF THE DRAWINGS

Further advantageous configurations and aspects of the invention are set out in the subclaims and in the exemplary embodiments of the invention described below. The invention is also described in more detail based on preferred embodiments with reference to the accompanying figures, in which:

DETAILED DESCRIPTION OF EXEMPLARY EMBODIMENTS OF THE PRESENT INVENTION

Figure 1:
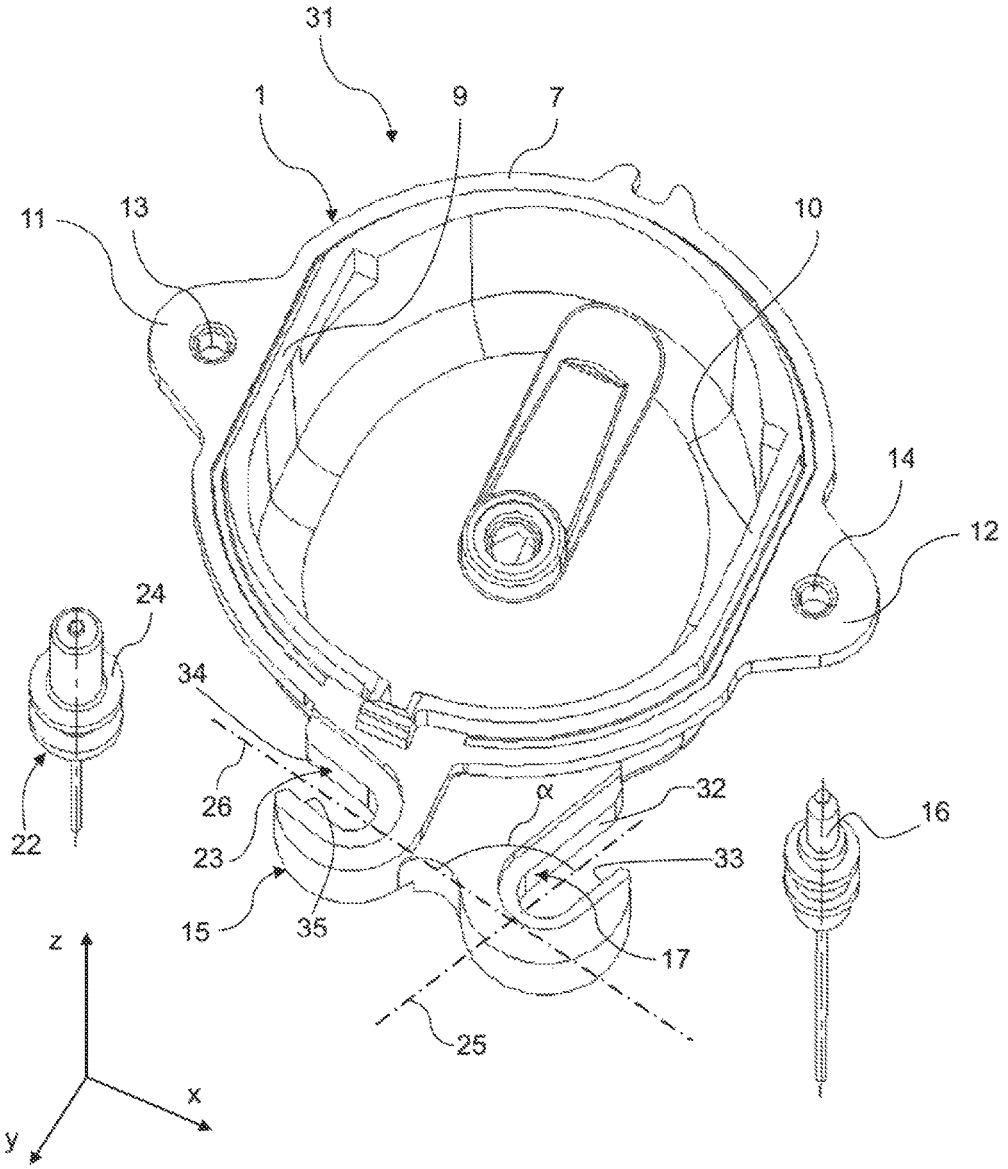
FIG. 1 shows a schematic perspective view of an embodiment of a gas burner.

Identical elements or those of identical function are shown with the same reference characters in the figures, unless otherwise stated.

FIG. 1 shows a schematic perspective view of a gas burner 31. The gas burner 31 has a base segment or burner pan 1. An upper part (not shown in the figures) of the gas burner 31 can be arranged in or on the burner pan 1.

Figure 4:
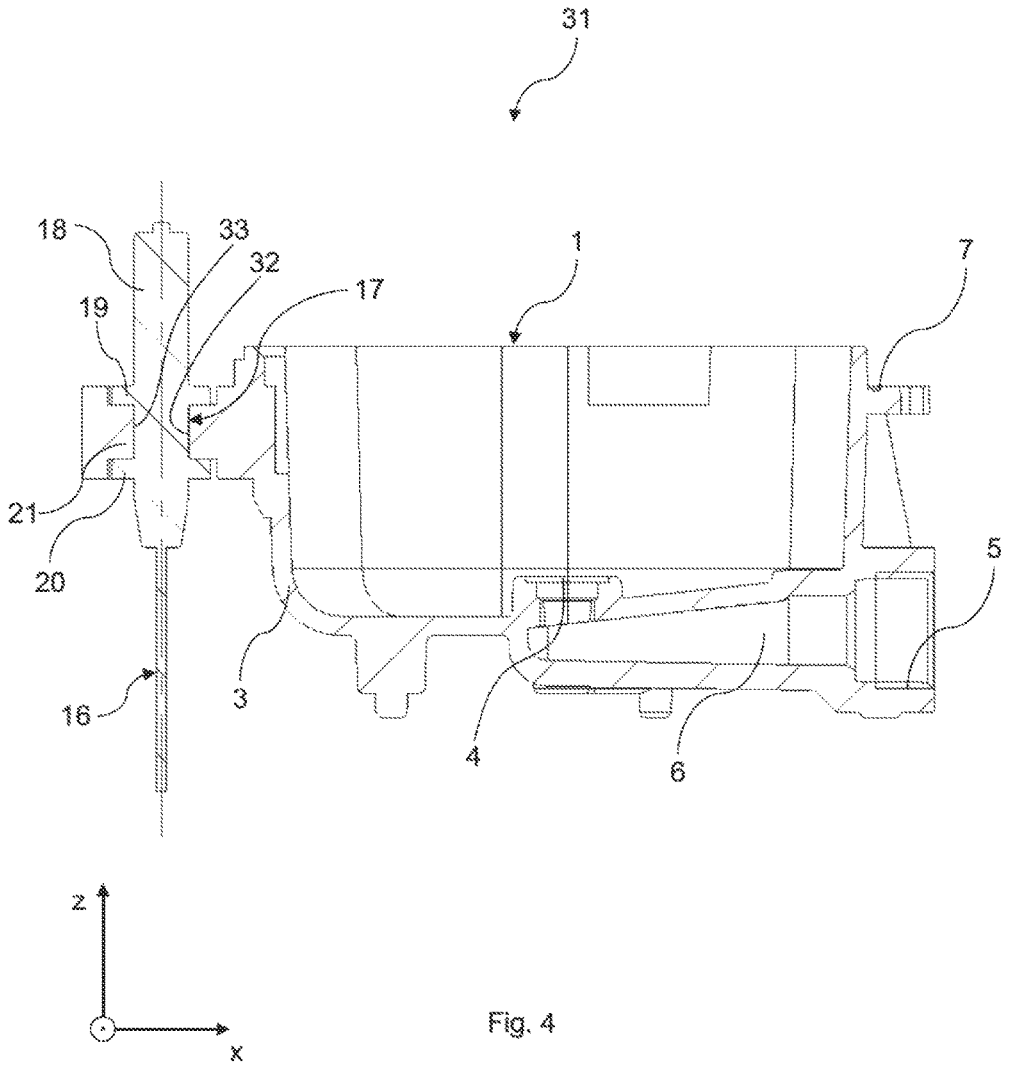
FIG. 4 shows a schematic sectional view of the gas burner according to FIG. 1.

As shown in FIG. 4, the burner pan 1 has a pan-type burner receiving segment 3 for receiving the upper part of the gas burner 31 and a nozzle receiving segment 4, preferably arranged in the center of the burner receiving segment 3, for receiving a gas injector nozzle of the gas burner 31. The burner pan 1 also has a gas connector 5 arranged at the side of the burner receiving segment 3. The gas connector 5 is connected fluidically to the nozzle receiving segment 4 by way of a gas duct 6.

The burner pan 1 also has a contact surface 7, which is designed to come into surface contact with a cooktop plate 8 of the cooktop 2. In particular the contact surface 7 is designed to come into surface contact with the lower face of the cooktop plate 8. The contact surface 7 runs round the edge of the burner receiving segment 3 preferably in the manner of a ring. In the top view the burner receiving segment 3 has a circular shape with two lateral flat portions 9, 10 arranged parallel to one another. The contact surface 7 has wing-type fastening segments 11, 12 in the region of said flat portions 9, 10. The burner pan 1 can be fastened to the cooktop plate 8 with the aid of the fastening segments 11, 12. A fastening hole 13, 14 is preferably provided on each of the fastening segments 11, 12. The fastening holes 13, 14 can be embodied as threaded holes.

The burner pan 1 also comprises a holding device 15 for holding a thermal element 16. The thermal element 16 is designed to detect the operating state of the gas burner 31. The holding device 15 and contact surface 7 are preferably configured from a single piece of material. The holding device 15 has a thermal element receiving slot 17 positioned perpendicular to the contact surface 7. In particular side flanks 32, 33 of the thermal element receiving slot 17 are positioned perpendicular to the contact surface 7. The thermal element 16 can be pushed into the thermal element receiving slot 17 laterally and in particular parallel to the contact surface 7. Perpendicular here means an angle of 90°±10°, more preferably 90°±5°, more preferably 90°±1°, more preferably precisely 90°.

As shown in FIG. 4, a housing 18 of the thermal element 16 can engage with a form fit behind the thermal element receiving slot 17 so that the thermal element 16 can be fixed perpendicular to the contact surface 7. In particular the thermal element 16 can be fixed in the z direction of the burner pan 1. The holding device 15 is preferably plate-shaped. FIG. 4 shows a coordinates system indicating an x, y and z direction of the gas burner 31 or the burner pan 1. The housing 18 of the thermal element 16 is preferably configured in the manner of a pin with two flanges 19, 20 arranged at a distance from one another and running round the edge of the housing 18 in the manner of a ring. The thermal element receiving slot 17 has an engagement segment 21, which engages between the flanges 19, 20. The thermal element receiving slot 17 therefore has the shape of an H on its side in the orientation in FIG. 4.

The holding device 15 is also additionally designed to hold an ignition element 22 of the gas burner 31. To this end the holding device 15 preferably has an ignition element receiving slot 23 positioned perpendicular to the contact surface 7. In particular side flanks 34, 35 of the ignition element receiving slot 23 are positioned perpendicular to the contact surface 7. A housing 24 of the ignition element 22 can engage with a form fit behind the ignition element receiving slot 23 so that the ignition element 22 is fixed perpendicular to the contact surface 7 and in particular in the z direction of the burner pan 1. The housing 24 of the ignition element 22 is preferably configured in the same way as the housing 18 of the thermal element 16.

The thermal element receiving slot 17 and the ignition element receiving slot 23 are preferably arranged in such a manner that they run toward one another. In particular a center line 25 of the thermal element receiving slot 23 is arranged in such a manner that it intersects a center line 26 of the ignition element receiving slot 23. The thermal element receiving slot 17 and the ignition element receiving slot 23 are preferably arranged at a predefined angle $\alpha$ to one another. In other words the center lines 25, 26 intersect at the angle $\alpha$. The predefined angle $\alpha$ is preferably 90° to 120°, more preferably 95° to 115°, more preferably 100° to 110°.

Figure 2:
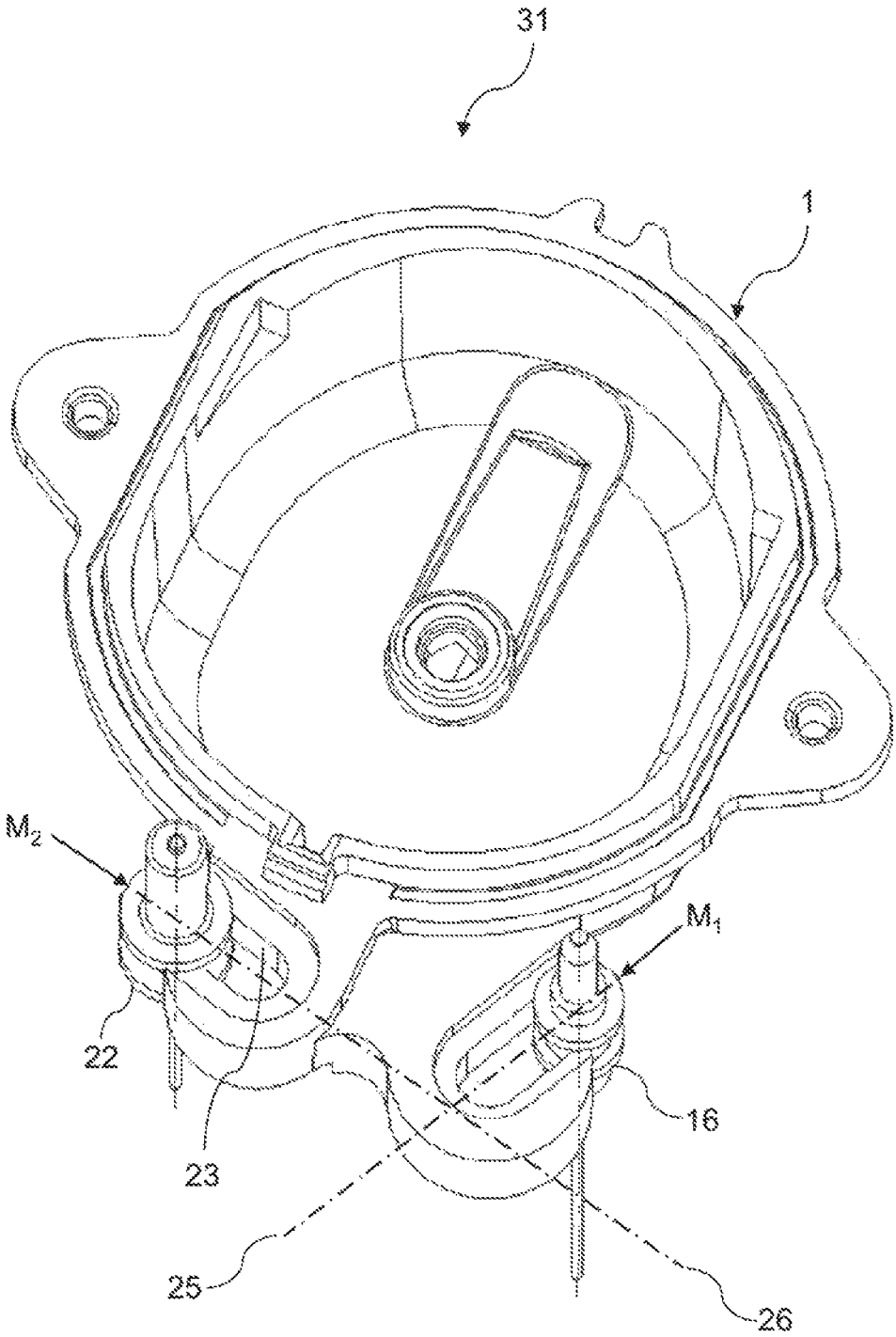
FIG. 2 shows a further schematic perspective view of the gas burner according to FIG. 1.

FIG. 2 shows the thermal element 16 being pushed in in a first mounting direction $M_1$ and the ignition element 22 being pushed into the ignition element receiving slot 23 in a second mounting direction $M_2$. The mounting directions $M_1$ and $M_2$ are oriented along the center lines 25 and 26.

Figure 3:
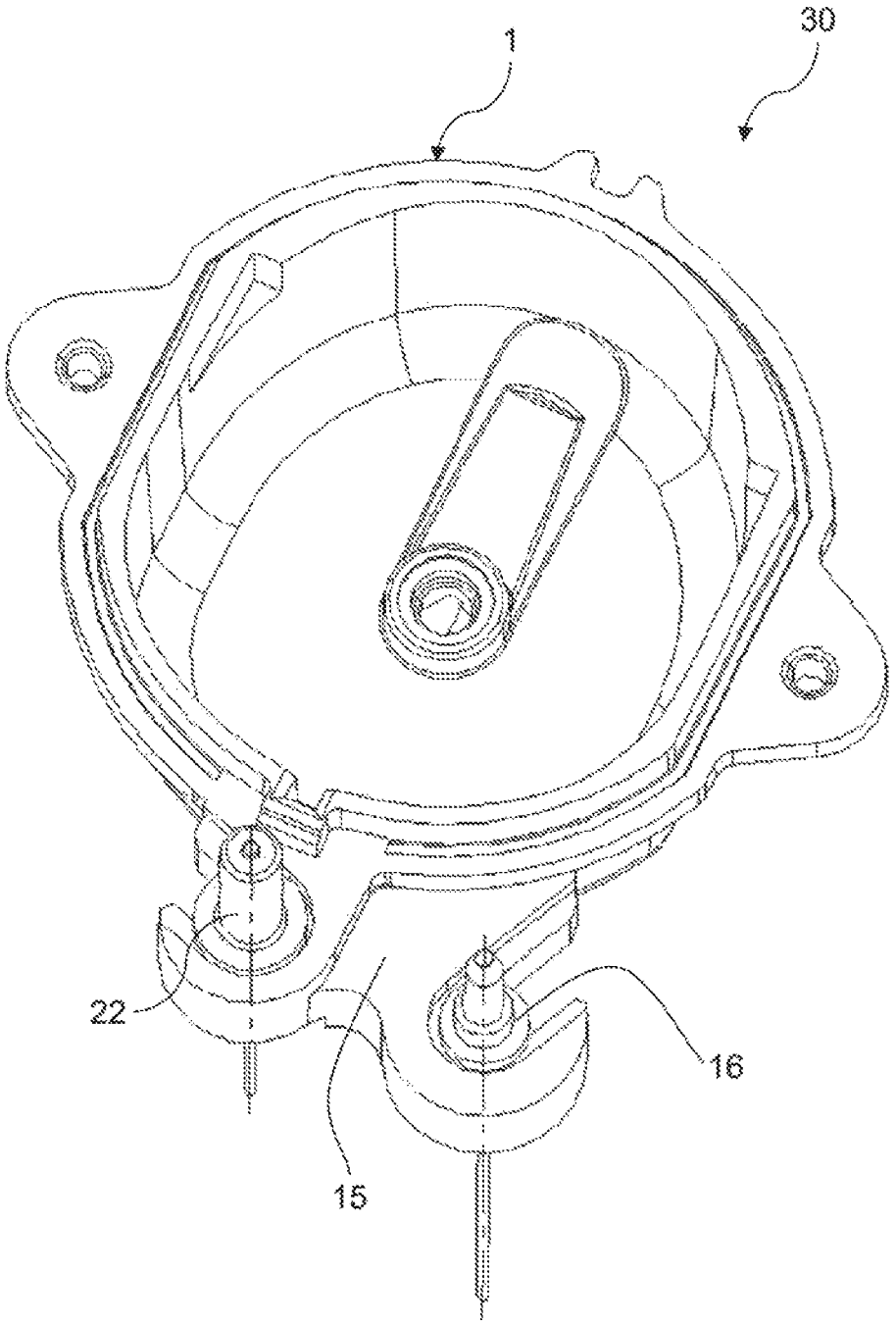
FIG. 3 shows further schematic perspective view of the gas burner according to FIG. 1.

FIG. 3 shows the thermal element 16 mounted on the gas burner 31 or on the burner pan 1 and the ignition element 22 mounted on the gas burner 31 or the burner pan 1. The gas burner 31, the thermal element 16 and the ignition element 22 can form a gas burner arrangement 30.

Figure 6:
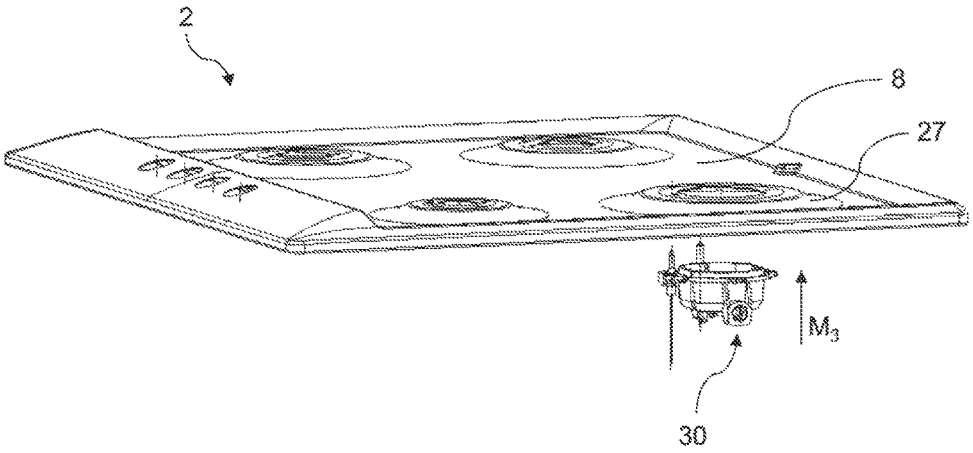
FIG. 6 shows a further schematic perspective view of the cooktop according to FIG. 5.

The gas burner 31 can be screwed in particular to a fastening ring 27 that can be positioned on the cooktop plate 8. FIG. 6 shows the mounting of the gas burner 31 with the thermal element 16 and the ignition element 22 from a lower face of the cooktop plate 8 in a mounting direction $M_3$. The fastening ring 27 is arranged on the upper face of the cooktop plate 8.

Figure 5:
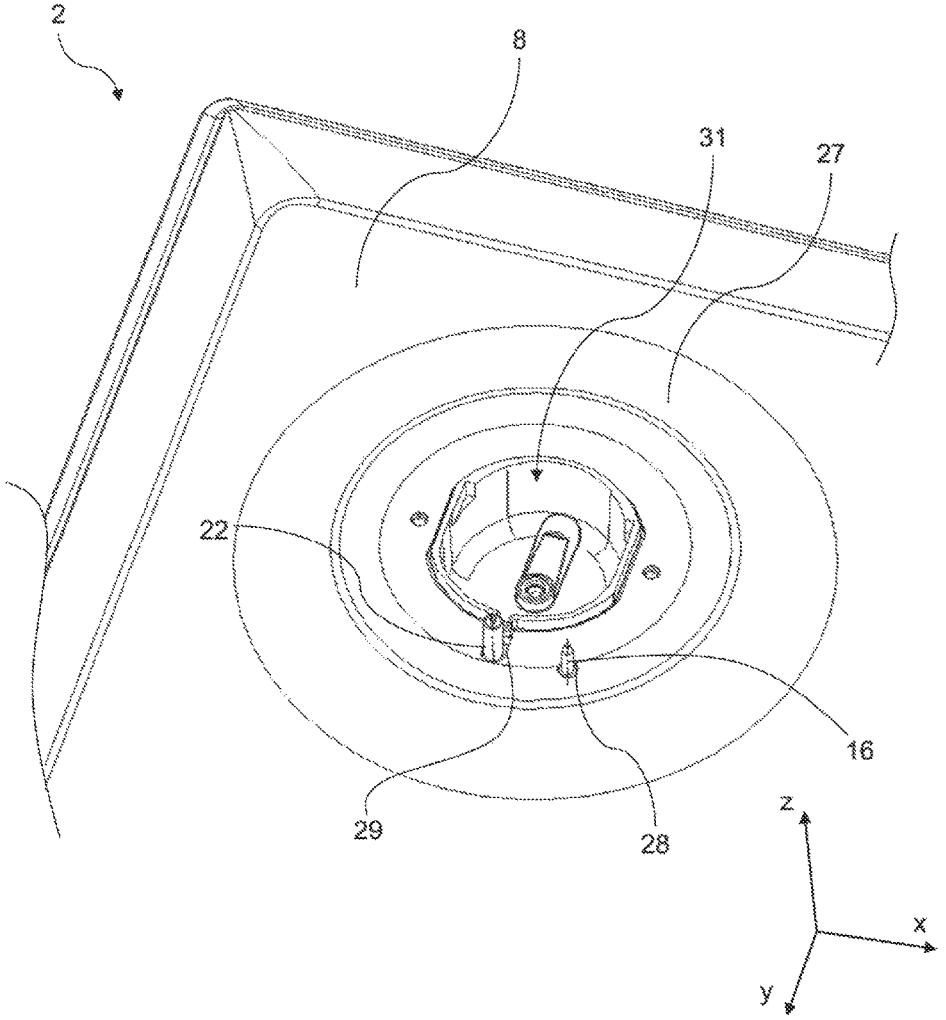
FIG. 5 shows a schematic perspective view of an embodiment of a cooktop.
Figure 7:
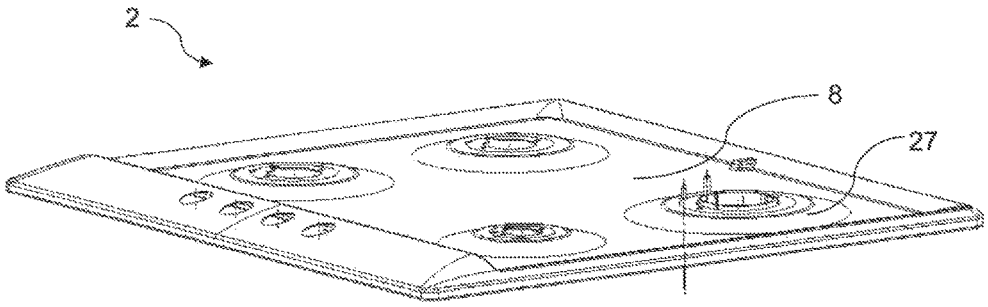
FIG. 7 shows a further schematic perspective view of the cooktop according to FIG. 5.

FIG. 7 shows the already mounted cooktop 2. The fastening ring 27 here is screwed to the burner pan 1 with the aid of the latter's fastening holes 13, 14. As shown in FIG. 5, the fastening ring 27 has a recess 28 for the thermal element 16 and a recess 29 for the ignition element 22. When the burner pan 1 is mounted on the cooktop plate 8, the thermal element 16 and the ignition element 22 are pushed through the corresponding recesses 28, 29 and are thus fixed in the x and y directions of the burner pan 1.

The gas burner arrangement 30 has the gas burner 31 with the burner pan 1 and at least the thermal element 16, which is pushed laterally into the thermal element receiving slot 17. The gas burner arrangement 30 can also have the ignition element 22, which is pushed laterally into the ignition element receiving slot 23 of the holding device 15. The cooktop 2 can also have the fastening ring 27 in addition to the cooktop plate 8, the gas burner 31 and the burner pan 1.

The present invention can be modified in many ways despite being described with reference to exemplary embodiments.

REFERENCE CHARACTERS USED

1 Burner pan
2 Cooktop
3 Burner receiving segment
4 Nozzle receiving segment
5 Gas connector
6 Gas duct
7 Contact surface
8 Cooktop plate
9 Flat portion
10 Flat portion
11 Fastening segment
12 Fastening segment
13 Fastening hole
14 Fastening hole
15 Holding device
16 Thermal element
17 Thermal element receiving slot
18 Housing
19 Flange
20 Flange
21 Engagement segment
22 Ignition element
23 Ignition element receiving slot
24 Housing
25 Center line
26 Center line
27 Fastening ring
28 Recess
29 Recess
30 Gas burner arrangement
31 Gas burner
32 Side flank
33 Side flank
34 Side flank
35 Side flank
$M_1$ Mounting direction
$M_2$ Mounting direction
$M_3$ Mounting direction
$\alpha$ Angle

The invention claimed is:

1. A gas burner configured to be mounted on for a cooktop, comprising:

a contact surface configured to come into surface contact with a cooktop plate of the cooktop;

a thermal element having a housing, the housing of the thermal element having a pair of flanges; and a holding device having a thermal element receiving slot including a laterally facing opening for allowing the thermal element to be pushed into the thermal element receiving slot in a direction laterally parallel to the contact surface, wherein the holding device of the gas burner includes a side flank on an inner vertical surface of the thermal element receiving slot and extending around the thermal element receiving slot from a first edge of the laterally facing opening to a second edge of the laterally facing opening such that the side flank directly contacts an inner surface of each flange of the pair of flanges.

2. The gas burner of claim 1, wherein the thermal element receiving slot is configured for engagement with the housing of the thermal element behind the thermal element receiving slot with a form fit so that the thermal element is securable in perpendicular relation to the contact surface.

3. The gas burner of claim 1, wherein the holding device is plate-shaped.

4. The gas burner of claim 1, wherein the holding device is configured to hold a housing of an ignition element.

5. The gas burner of claim 4, wherein the holding device has an ignition element receiving slot including a laterally facing opening configured to enable the housing of the ignition element to be pushed into the ignition element receiving slot in a direction laterally parallel to the contact surface.

6. The gas burner of claim 5, wherein the ignition element receiving slot is configured for engagement with the of a housing of the ignition element behind the ignition element receiving slot with a form fit so that the ignition element is securable in perpendicular relation to the contact surface.

7. The gas burner of claim 5, wherein the thermal element receiving slot and the ignition element receiving slot are arranged in such a manner that they run toward one another.

8. The gas burner of claim 5, wherein the thermal element receiving slot and the ignition element receiving slot are arranged at a predefined angle to one another.

9. The gas burner of claim 1, constructed for threaded engagement to a fastening ring on the cooktop plate.

10. A gas burner arrangement configured to be mounted on a cooktop, comprising:

a thermal element having a housing, the housing of the thermal element having a pair of flanges; and a gas burner configured to be mounted to the cooktop plate of the cooktop, the gas burner including:

a contact surface configured to come into surface contact with a cooktop plate of the cooktop; and a holding device having a thermal element receiving slot including a laterally facing opening for allowing the thermal element to be pushed into the thermal element receiving slot in a direction laterally parallel to the contact surface, wherein the holding device of the gas burner includes a side flank on an inner vertical surface of the thermal element receiving slot and extending around the thermal element receiving slot from a first edge of the laterally facing opening to a second edge of the laterally facing opening such that the side flank directly contacts an inner surface of each flange of the pair of flanges.

11. The gas burner arrangement of claim 10, wherein the thermal element receiving slot is configured for engagement with the housing of the thermal element behind the thermal element receiving slot with a form fit so that the thermal element is fixed in perpendicular relation to the contact surface.

12. The gas burner arrangement of claim 10, wherein the holding device is plate-shaped.

13. The gas burner arrangement of claim 10, wherein the gas burner arrangement further includes:

an ignition element having a housing, wherein the holding device includes an ignition element receiving slot including a laterally facing opening configured to enable the housing of the ignition element to be pushed into the ignition element receiving slot in a direction laterally parallel to the contact surface.

14. The gas burner arrangement of claim 13, wherein the housing of the ignition element is configured for engagement behind the ignition element receiving slot with a form fit so that the ignition element is fixed in perpendicular relation to the contact surface.

15. The gas burner arrangement of claim 13, wherein the thermal element receiving slot and the ignition element receiving slot are arranged in such a manner that they run toward one another.

16. The gas burner arrangement of claim 13, wherein the thermal element receiving slot and the ignition element receiving slot are arranged at a predefined angle to one another.

17. The gas burner arrangement of claim 10, wherein the gas burner is constructed for threaded engagement to a fastening ring on the cooktop plate.

18. A cooktop, comprising:

a cooktop plate; and a gas burner mounted to the cooktop plate of the cooktop, wherein the gas burner includes:

a contact surface configured to come into surface contact with the cooktop plate of the cooktop;

a thermal element having a housing, the housing of the thermal element having a pair of flanges; and a holding device having a thermal element receiving slot including a laterally facing opening for allowing the thermal element to be pushed into the thermal element receiving slot in a direction laterally parallel to the contact surface, wherein the holding device of the gas burner includes a side flank on an inner vertical surface of the thermal element receiving slot and extending around the thermal element receiving slot from a first edge of the laterally facing opening to a second edge of the laterally facing opening such that the side flank directly contacts an inner surface of each flange of the pair of flanges.

19. The cooktop of claim 18, constructed in the form of a gas cooktop.

20. The cooktop of claim 18, further comprising a fastening ring placed on the cooktop plate, said fastening ring being configured to connect the gas burner to the cooktop plate.

21. The gas burner of claim 1, wherein the side flank of the holding device is positioned perpendicular to the contact surface.

22. The gas burner of claim 1, wherein the thermal element receiving slot has a cross-sectional shape of a sideways H with respect to the contact surface.

23. The gas burner of claim 5, wherein the holding device comprises a second side flank extending into the ignition element receiving slot, the second side flank of the ignition element receiving slot configured to engage a portion of the housing of the ignition element such that the ignition element can be fixed in a perpendicular direction with respect to the contact surface.

24. The gas burner of claim 1, wherein the holding device comprises:

an ignition element receiving slot including a laterally facing opening configured to hold a housing of an ignition element and to enable the housing of the ignition element to be pushed into the ignition element receiving slot in a direction laterally parallel to the contact surface, wherein the housing of the ignition element has a pair of flanges, and a second side flank on an inner vertical surface of the ignition element receiving slot and extending around the ignition element receiving slot from a first edge of the laterally facing opening to a second edge of the laterally facing opening of the ignition element receiving slot such that the second side flank directly contacts an inner surface of each flange of the pair of flanges of the ignition element and such that the ignition element can be fixed in the perpendicular direction with respect to the contact surface.

25. The gas burner arrangement of claim 10, wherein the side flank engages between the pair of flanges of the housing of the thermal element such that the thermal element is fixed in a perpendicular direction with respect to the contact surface.

26. The gas burner arrangement of claim 13, wherein the housing of the ignition element includes a pair of flanges, and wherein the holding device of the gas burner comprises a second side flank extending into the ignition element receiving slot, the second side flank engaging between the pair of flanges of the ignition element such that the ignition element is fixed in a perpendicular direction with respect to the contact surface.

27. The gas burner arrangement of claim 10, further comprising:

an ignition element having a housing, wherein the housing of the ignition element has a pair of flanges, wherein the holding device of the gas burner includes:

an ignition element receiving slot including a laterally facing opening configured to hold the ignition element and to enable the housing of the ignition element to be pushed into the ignition element receiving slot in a direction laterally parallel to the contact surface;

a second side flank on an inner vertical surface of the ignition element receiving slot and extending around the ignition element receiving slot from a first edge of the laterally facing opening to a second edge of the laterally facing opening of the ignition element receiving slot such that the second side flank directly contacts an inner surface of each flange of the pair of flanges of the ignition element and such that the ignition element can be fixed in the perpendicular direction with respect to the contact surface.

* * * * *